United States Patent [19]

Ito et al.

[11] 4,326,715

[45] Apr. 27, 1982

[54] SIMULATED BASEBALL GAME DEVICE

[75] Inventors: Hiroshi Ito; Haruyuki Tanaka, both of Mibu, Japan

[73] Assignee: Bandai Industry Co., Ltd., Tochigi, Japan

[21] Appl. No.: 147,687

[22] Filed: May 7, 1980

[30] Foreign Application Priority Data

Jun. 2, 1979 [JP] Japan ..... 54-74802[U]

[51] Int. Cl.[3] ..... A63F 9/00

[52] U.S. Cl. ..... 273/88

[58] Field of Search ..... 273/88, 85 G, 1 E, 1 GC, 273/1 GE, 138 A

[56] References Cited

U.S. PATENT DOCUMENTS

| | | | |
|---|---|---|---|
| 2,696,384 | 12/1954 | Roth | 273/88 |
| 2,883,193 | 4/1959 | Iannone et al. | 273/88 |
| 3,284,083 | 11/1966 | Levin et al. | 273/138 A |
| 3,606,329 | 9/1971 | Wilson | 273/88 |
| 3,655,189 | 4/1972 | Alexander, Jr. | 273/88 |
| 3,790,170 | 2/1974 | Alexander, Jr. | 273/88 |
| 3,902,723 | 9/1975 | Colling et al. | 273/1 GE X |
| 4,022,465 | 5/1977 | Colling et al. | 273/1 GC |
| 4,060,242 | 11/1977 | Huang et al. | 273/138 A X |
| 4,195,838 | 4/1980 | Santandrea et al. | 273/88 |
| 4,260,159 | 4/1981 | Hoffman | 273/138 A |

*Primary Examiner*—William H. Grieb

*Attorney, Agent, or Firm*—Jordan and Hamburg

[57] ABSTRACT

A game device includes a control switch for generating control signals, and a delay circuit for delaying the control signals. A first oscillation circuit is controlled by the output of said delay circuit. A second oscillation circuit is connected to receive the output of said first oscillation circuit. A sound generator is driven by the output of said second oscillation circuit. A counter is controlled by the output of said first oscillation circuit. A plurality of light-emitting elements are driven by the output of said counter and arranged in desired form on a display panel. The counter counts the oscillations of the first oscillation circuit. The second oscillation circuit oscillates intermittently in synchronism with the counting operation.

10 Claims, 3 Drawing Figures

SIMULATED BASEBALL GAME DEVICE

BACKGROUND OF THE INVENTION

The present invention relates to a game device which can be played by one or several players.

Various game devices have heretofore been proposed, but very few are inexpensive and yet sufficiently satisfy the interest of a player or players using simple manipulations.

It is therefore the object of this invention to provide a game device which is economical and which can be operated in a simple manner and yet sufficiently satisfy the interest of a player or players.

Briefly stated, the invention comprises a first oscillator connected to a counter, with a plurality of LEDs connected to the counter to be sequentially lit. The first counter is energized by a control switch, by way of a relay circuit. The LEDs are arranged in any desired pattern on a display board. The output of the first oscillator also energizes a second oscillation circuit which in turn produces an audible output.

BRIEF DESCRIPTION OF THE DRAWINGS

Hereinafter, an embodiment of the present invention will be explained in detail with reference to the accompanying drawings wherein.

DETAILED DESCRIPTION OF A PREFERRED EMBODIMENT

Figure 1:
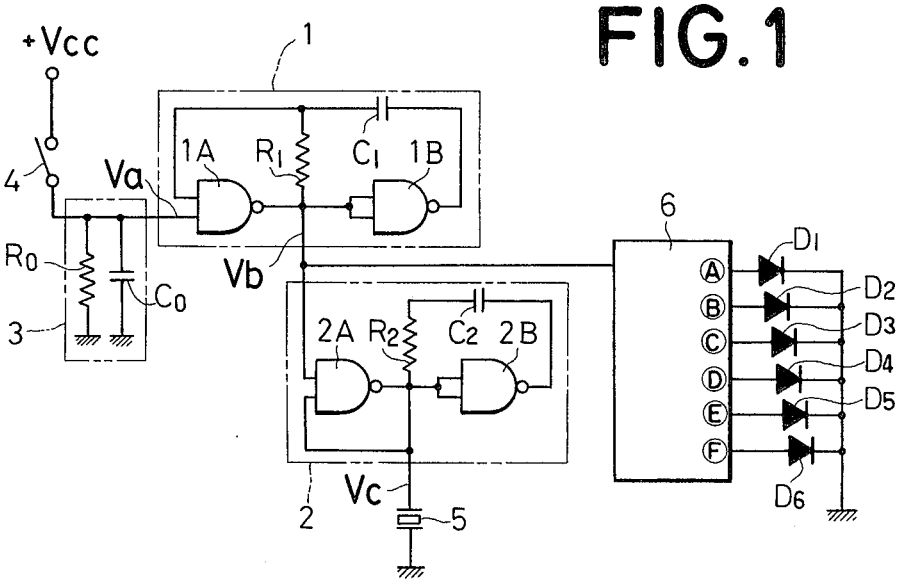
FIG. 1 is a circuit diagram of a game in accordance with the invention.

FIG. 1 is a circuit diagram showing an embodiment of the present invention wherein reference numeral 1 represents a first oscillator consisting of two cascade-connected NAND gates 1A and 1B. Resistor $R_1$ and capacitor $C_1$ set the time constant of this oscillator. Reference numeral 2 represents a second oscillator consisting of two cascade-connected NAND gates 2A and 2B. Resistor $R_2$ and capacitor $C_2$ set the time constant of the second oscillator. This second oscillator is to be driven by an output signal $V_b$ of the first oscillator 1.

In this case, one input of the NAND gate 1 of the first oscillator 1 is electrically connected to a controlling power source $+V_{cc}$ via a delay circuit 3 and a control switch 4 that are disposed in the input stage of the oscillator. Accordingly, when the control switch 4 is turned on, a voltage is impressed upon the first NAND gate via the delay circuit 3, thereby actuating the first oscillation circuit. The second oscillator 2 is driven by the output signal of the first oscillator 1 and produces an output $V_c$. A piezoelectric element 5 is connected as a sound-generating element to the output terminal of this second oscillator 2 so that the generation of sound is controlled by means of the output $V_c$.

Reference numeral 6 represents a conventional counter connected to be actuated by the oscillation output of the first oscillator 1 and has at least six output terminals A through F. Light-emitting diodes $D_1$–$D_6$ are connected to these output terminals, respectively, and the cathodes of these diodes are grounded in common. This counter 6 counts the oscillator output (clock pulses) of the first oscillator 1 and so functions to deliver high level outputs "H" sequentially to the output terminals A through F. This counting action sequentially turns the light-emitting diodes $D_1$–$D_6$ on and off. The oscillators 1 and 2 and the counter 6 are all conventional IC's (semiconductor integrated circuits).

In operation, a power source voltage (not shown) is first applied to each circuit. Under this condition, with the switch 4 open, the first oscillator 1 does not oscillate because the control switch 4 is in the off state. In this instance, the output $V_b$ of the first oscillator 1 is fixed at the "H" level and is impressed upon the second oscillator 2 so that the latter oscillates at its natural oscillation frequency and impresses its output $V_c$ upon the piezoelectric element 5. In consequence, a continuous sound is produced from the piezoelectric element 5. The oscillation frequency of the second oscillator 2 is determined by setting $R_2$ and $C_2$ as the time constant-setting elements. In this embodiment, the oscillation frequency is set at about 500 Hz.

Under this condition, the counter 6 is not operative. Since the input signal $V_b$ is at the "H" level, however, an output is produced at one of the output terminals A through F, so that only the light-emitting diode connected to that terminal is lit. Next, when the control switch 4 is turned on, a control signal $V_a$ is produced, whereby an "H" signal is impressed via the delay circuit 3 upon the NAND gate 1A of the first oscillator 1. Hence, the oscillator 1 starts oscillating. The oscillation frequency in this instance is determined by the values of the resistor $R_1$ and capacitor $C_1$ for setting the time constant. In this embodiment, the oscillation output is set at about 15 Hz. This 15 Hz oscillation output $V_b$ is impressed upon the counter 6 to initiate the counting operation.

Figure 2:
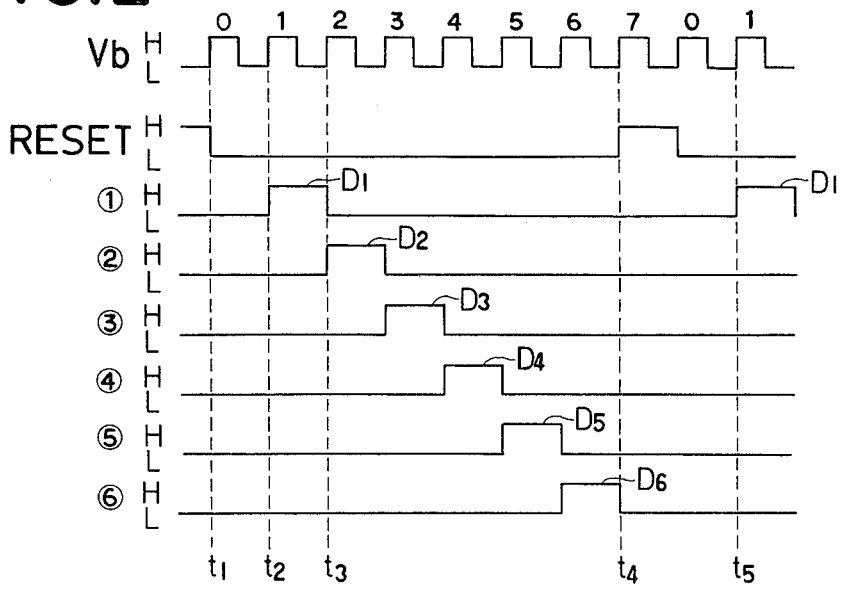
FIG. 2 illustrates the wave forms at various points in the circuit of FIG. 1.

The operation of this counter 6 will now be explained in detail with reference to the timing chart of FIG. 2.

The counter 6 is first reset by the first pulse "0" of the oscillation output $V_b$ (at time $t_1$). The voltage at the first output terminal A then rises to the "H" level in synchronism with the rise of the second pulse "1" (at time $t_2$). The voltage at the second output terminal B rises to the "H" level in synchronism with the fall of the voltage at the output terminal A (at time $t_3$). In the same way as above, the voltage at an output terminal of a subsequent stage thereafter rises to the "H" level in synchronism with the fall of the voltage of an output terminal at a preceeding stage, thereby producing the counting action. The output terminal of the counter 6 and the reset terminal are connected so that, when the voltage of the final output terminal F rises up to the "H" level, a reset signal is impressed upon the counter 6 in synchronism with the rise of the pulse "7" of the eighth input signal $V_b$. This arrangement enables the counter 6 to return to its original state (at time $t_4$).

Thereafter, the abovementioned action is repeated (timing $t_5$). This counting action sequentially turns the light-emitting diodes $D_1$–$D_6$ connected to the output terminals on and off, respectively. When the oscillation output $V_b$ of the first oscillator stops in the course of the counting action, the counting action also stops, with the result that the one of the light-emitting diodes that is then on, immediately before the stop, will remain on.

The state of the oscillation output $V_b$ of the first oscillation circuit 1 controls the oscillating action of the second oscillator 2. In other words, the oscillation is effected at the "H" level of the abovementioned oscillation output $V_b$ (15 Hz clock pulse) and stops at the "L" level. The oscillation is thus intermittent. Since the intermittent oscillation output $V_c$ is impressed upon the piezoelectric element 5, this element produces an intermittent sound. When the oscillating action of the first oscillation circuit stops, the piezoelectric element 5 again produces the continuous sound. The production of this continuous sound by the piezoelectric element 5 and the sequential lighting of the light-emitting diodes $D_1$–$D_6$ disposed at the output terminals of the counter 6 are in synchronism with each other.

As described above, by keeping the control switch 4 in the ON state, it is possible to sequentially turn the light-emitting diodes on and off in synchronism with the production of the intermittent sound, and by keeping the control switch 4 in the OFF state, it is possible to synchronize the lighting of one selected light-emitting diode with the production of the continuous sound. In the circuit described above, since the delay circuit 3 is connected after the control switch 4, the original state is not directly resumed immediately after the control switch 4 is turned off, but occurs only after the passage of the delay time. This delay time is determined by the set values of the resistor $R_o$ and capacitor $C_o$. In this embodiment, the delay time is set at about 3 seconds.

Figure 3:
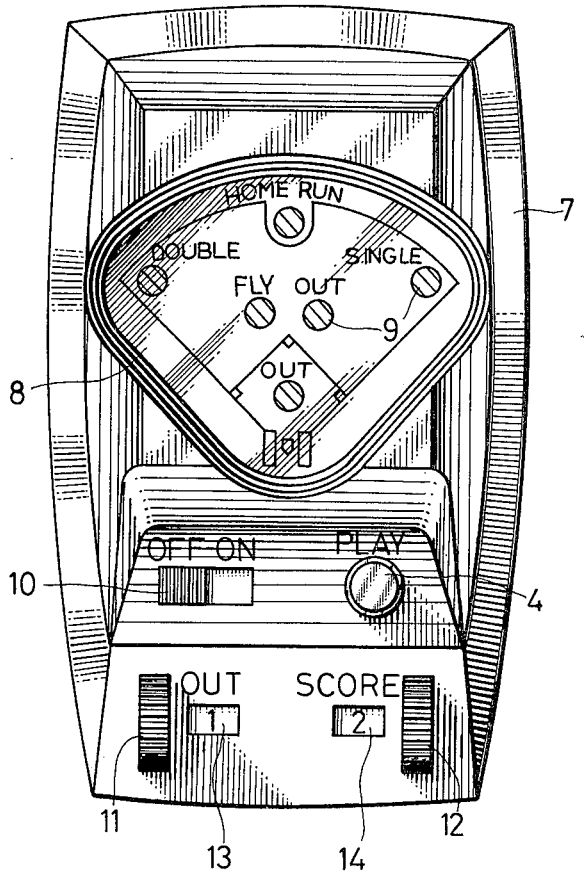
FIG. 3 is a top view of a game board which may incorporate the circuit of the invention.

FIG. 3 is a plan view showing the appearance of the baseball game device incorporating therein the above-mentioned circuit. In the drawing, reference numeral 7 represents the main frame of the device, and a flat portion 8 bearing the picture of a baseball field is disposed substantially at the center of the main frame. Six windows 9 each having a transparent cover are arranged in this flat portion 8 with suitable gaps between them. The aforementioned light-emitting diodes $D_1$–$D_6$ are mounted in these six windows 9, respectively, and characters representing the course of a ball are applied to the upper portion of each window 9. A switch 10 for connecting and disconnecting the power source to and from the device is disposed immediately below the flat portion 8 and a push-button switch corresponding to the aforementioned control switch 4 is disposed on the right side of the switch 10.

Further, two dials 11 and 12 are disposed at the lower portion of the main frame 7 of the device and display plates 13 and 14 are fitted by the side of these dials, respectively. The numerical values represented by these display plates vary whenever the dials are manipulated. Of the two display plates, the word "OUT" is placed about the dial 13 and the word "SCORE", on the dial 14. The device incorporates therein the aforementioned circuit and a battery as the power source.

The baseball device of the invention is operated in the following manner. First, the dials 11 and 12 at the lower part of the main frame are manipulated so that the figure "0" appears on both display plates. Next, when the power switch 10 is turned ON, the light-emitting diode of the window at an optional position is automatically lit. When the operator pushes the push-button switch 4, however, the six light-emitting diodes are sequentially turned on and off. When the push button 4 is released, the light-emitting diode at the randomly selected position lights in a short time. Judgement is then made by reading the position of light as to whether the action is "OUT", "HOME-RUN" or the like. If the light-emitting diode at "OUT" is lit, the dial 11 is operated so that "1" is displayed on the display plate 13. If the light-emitting diode at "HOMERUN" is lit, the dial 12 is operated until "1" appears on the display plate 14. This procedure is carried out in the same way as in the rules of baseball to enjoy the baseball game using the device of the invention.

In this case, the positions of the flashing light-emitting diodes are irregularly changed by the selection of the release timing of the push button and moreover, there is a delay time from the lighting of one diode to another. This induces the operator's anticipation and further enhances his interest. The game can be enjoyed by two or more players by alternately manipulating the push button, and is therefore of wide use.

The present invention is not restricted to the above-described embodiment. In the embodiment illustrated, for example, the light-emitting diodes are sequentially lit and the intermittent sound is generated when the control switch is turned ON. Contrary to this arrangement, it is also possible to sequentially light the diodes and to produce the continuous sound simultaneously with the turning on of the power switch, and to selectively light the light-emitting diode and to produce the continuous sound when the control switch 4 is turned on. Further, the constructions and operations of the oscillators, counter and delay circuit are not limited to those in the above-described embodiment. Still further, the set value of the frequency may be suitably changed in accordance with the application and the sound-generating element is not restricted to the use of a piezoelectric element. If necessary, a stabilizing capacitor may be interposed in each oscillation circuit so as to stabilize the oscillating action. Incidentally, this game device can be applied not only to a baseball game but also to other games.

The device of the present invention as has thus been described is constructed by a simple circuit and most of the component parts are substantially those for the IC. Hence, the device of the invention can be economically produced and made compact in size. Thus, it is possible to provide a game device which, though economical in the cost of production and simple in construction, can sufficiently satisfy the player's interest.

While the invention has been disclosed and described with reference to a single embodiment, it will be apparent that variations and modifications may be made therein, and it is therefore intended, in the following claims, to cover each said variation and modification as falls within the true spirit and scope of the invention.

What is claimed is:

1. A game apparatus comprising a first oscillator, a counter connected to count the oscillations of said first oscillator, a plurality of light-emitting devices visably arranged on said apparatus and connected to be sequentially energized by said counter, switch means connected to enable said first oscillator to oscillate a second oscillator, sound generating means connected to said second oscillator, and means applying the output of said first oscillator to control the oscillation of said second oscillator.

2. The game apparatus of claim 1 wherein said first oscillator comprises a pair of cascade-connected NAND gates.

3. The game apparatus of claim 1 wherein said second oscillator comprises a pair of cascade-connected NAND gates.

4. The game apparatus of claim 1 wherein said switch means connected to enable said oscillator to oscillate comprises a delay circuit, whereby control of the oscillation of said first oscillator is delayed.

5. The game apparatus of claim 1 wherein said first oscillator comprises a NAND gate, said switch means comprises a switch having one terminal connected to a source of voltage, and the other terminal connected to one input of said NAND gate, and further comprising a delay circuit comprising a parallel-connected resistor and capacitor between ground reference and said other terminal of said switch.

6. The game apparatus of claim 1 comprising a frame, said light-emitting devices being selectively mounted in said frame, and further comprising and ON-OFF switch connected to energize and deenergize said first oscillator, and further comprising an ON-OFF switch connected to energize and deenergize said apparatus.

7. The game apparatus of claim 6 wherein said frame is arranged in the form of a baseball field.

8. The game apparatus of claim 1 wherein said sound generating means comprises a piezoelectric element.

9. The game apparatus of claim 1 wherein said second oscillator is connected to continuously oscillate when said first oscillator is disabled by said switch means, and to periodically be turned on in synchronism with the oscillations of said first oscillator when said switch means is connected to energize said first oscillator.

10. The game apparatus of claim 1 wherein said first and second oscillator each comprise a pair of cascade-connected NAND gates, the output of said first oscillator is connected to one input of one of the NAND gates of said second oscillator, said switch means comprises a switch connected between a source of potential and input of one of the NAND gates of said first oscillator, and further comprising a delay circuit connected between said switch and said NAND gate of said first oscillator for delaying the cessation of oscillations of said first oscillator upon the opening of said switch.

* * * * *